US008468791B2

(12) United States Patent
Bartkowiak et al.

(10) Patent No.: US 8,468,791 B2
(45) Date of Patent: Jun. 25, 2013

(54) TEXTURING MACHINE

(75) Inventors: Klaus Bartkowiak, Herne (DE); Detlef Oberstrass, Velbert (DE); Martin Fischer, Solingen (DE); Hans-Georg Schröder, Köln (DE); Stefan Conrad, Remscheid (DE); Jörg Schippel, Remscheid (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 31 days.

(21) Appl. No.: 13/055,356

(22) PCT Filed: Jul. 15, 2009

(86) PCT No.: PCT/EP2009/059031
§ 371 (c)(1),
(2), (4) Date: Apr. 12, 2011

(87) PCT Pub. No.: WO2010/010016
PCT Pub. Date: Jan. 28, 2010

(65) Prior Publication Data
US 2011/0308226 A1 Dec. 22, 2011

(30) Foreign Application Priority Data
Jul. 25, 2008 (DE) ..... 10 2008 034 731

(51) Int. Cl.
*D02G 1/02* (2006.01)

(52) U.S. Cl.
USPC ..... 57/290; 57/352

(58) Field of Classification Search
USPC ..... 57/282, 284, 290, 352
See application file for complete search history.

(56) References Cited

U.S. PATENT DOCUMENTS

| | | | | |
|---|---|---|---|---|
| 3,142,951 | A * | 8/1964 | Terra | 57/282 |
| 4,395,872 | A | 8/1983 | Riedl | |
| 4,719,745 | A * | 1/1988 | Konig | 57/291 |

(Continued)

FOREIGN PATENT DOCUMENTS

| | | | |
|---|---|---|---|
| DE | 37 23 200 | | 8/1988 |
| EP | 0 020 285 | | 12/1980 |
| JP | 63309636 | | 12/1988 |
| JP | 06184847 | A * | 7/1994 |
| WO | WO 2005/064053 | | 7/2005 |

OTHER PUBLICATIONS

International Preliminary Report on Patentability and Written Opinion for Application No. PCT/EP2009/059031 dated Feb. 17, 2011.

*Primary Examiner* — Shaun R Hurley
(74) *Attorney, Agent, or Firm* — Alston & Bird LLP

(57) ABSTRACT

A texturing machine is described comprising a plurality of processing points for texturing a plurality of multifilament threads. The texturing machine comprises a plurality of delivery mechanisms per processing point and a texturing system for guiding, drawing and texturing one of the threads. A central heating device is associated with the processing points for thermal treatment of a plurality of threads, wherein the texturing systems within the processing points downstream of the heating device each delimit a texturing distance. In order to treat all threads qualitatively the same, according to the invention the texturing systems of the processing points associated with a thread outlet of the heating device are held in a symmetrical arrangement with respect to the heating device such that the threads within the processing points can be guided in texturing distances of the same length.

16 Claims, 4 Drawing Sheets

U.S. PATENT DOCUMENTS 4,905,468 A * 3/1990 Tanae et al. ..... 57/291
6,041,587 A * 3/2000 Gabalda et al. ..... 57/333
6,164,054 A 12/2000 Matas Gabalda et al.
6,349,532 B1 * 2/2002 Naylor ..... 57/284

* cited by examiner

TEXTURING MACHINE

BACKGROUND OF THE INVENTION

1. Field of the Invention

The invention concerns a texturing machine with a plurality of processing points for texturing of a plurality of multifilament threads.

2. Description of Related Art

A generic texturing machine is known from EP 0 039 938 A1.

In the known texturing machine the processing points have a plurality of delivery mechanisms and texturing units for guiding, drawing and texturing of the threads, which are arranged along a machine side wall. To carry out the thermal treatment of the threads required for the texturing process a central heating device is provided, through which a plurality of threads can be heat-treated simultaneously. The central heating device is arranged in the center relative to the processing points so that texturing zones of different length are formed depending on the position of the texturing units. The texturing zone is the guide zone of the thread in which the thread with a false twist is guided between the texturing unit and the heating device. It is generally known that, to achieve a textured structure of the thread, it is heated in the twisted state in the heating device to a treatment temperature lying above the glass transition temperature of the thread material. Thread drawing can thus simultaneously be executed within the texturing zone.

The problem in known texturing machines is that different lengths of the texturing zones prevail in the processing points. Only nonuniform texturings can therefore be generated in the threads. Different cooling and different twist transfers occur because of the length differences, especially in the texturing zones between the heating device and the texturing units. For this reason such texturing machines have not gained acceptance in practice.

A texturing machine is known from DE 37 23 200 A1 in which the processing points are held in a parallel arrangement along a machine side wall. Heating devices, which essentially extend over the entire width of the machine and have a treatment channel at each processing point, are used here. Such texturing machines permit the threads to be uniformly guided, drawn and textured in the processing points. It is then common to arrange up to 216 or more processing points next to each other on a machine side wall. Such texturing machines, however, require significant energy input especially for heat treatment of the threads.

The underlying task of the invention is therefore to devise a texturing machine for texturing of a plurality of multifilament threads in which uniform treatment is possible for texturing and drawing of the threads with limited energy input.

SUMMARY OF VARIOUS EMBODIMENTS

This task is solved according to the invention by a texturing machine as described herein in that the texturing units of the processing points, which texturing units are assigned to a thread outlet of the heating device, are held in a symmetric arrangement to the heating device so that the threads can be guided in equally long texturing zones within the processing points.

Advantageous modifications of the invention are defined by the various embodiments described herein.

The invention has the advantage that the process units in the processing points can be kept in a particularly compact arrangement so that the texture machine according to the invention requires much less space relative to conventional texturing machines. All threads guided in the processing points are also textured under the same conditions. The equally long texturing zones in the processing points permit identical heat treatments also in the cooling zones formed between the texturing units and the heating device and identical twist back transfers from the texturing unit to the heating device. The central heating device also offers the possibility of heat treatment of all threads confined to a narrow space. The costs for insulation and heating means can therefore be reduced to a minimum.

To obtain equally long guide zones in the processing points, the modification of the invention is particularly advantageous in which the delivery mechanisms of the processing points downstream of the texturing units in the thread path direction are held as individual delivery mechanisms in a symmetric arrangement relative to the heating device. Galette delivery mechanisms, which permit particularly mild thread guiding, can be used, for example.

The arrangement in which the heating device is aligned vertically and in which the texturing units are held in a partially circular arrangement next to each other with a spacing to the thread outlet of the heating device has turned out to be particularly advantageous for space utilization. With it, particularly operationally favorable thread paths, which are simple to operate at the beginning of the process, can be achieved within the texturing machine.

To obtain uniform stretching lengths when drawing the threads into the processing points, it is preferable to use the modification of the invention in which the delivery mechanisms of the processing points upstream of the heating device in the thread path direction are held as individual delivery mechanisms in a symmetric arrangement relative to a thread inlet of the heating device. The guide zones between the individual delivery mechanisms upstream of the heating device and a thread inlet of the heating device can therefore be designed equally long within the processing points. All zone lengths within the processing points are therefore made equally long.

A particularly favorable arrangement can be achieved in that the thread inlet is formed on a bottom and the thread outlet on a top of the heating device and that the texturing units are arranged in a plane above the heating device. The thread feeds can then advantageously be formed in a lower area of the machine.

Depending on the thread type and thread material, shrinkage treatment is conducted after texturing, for which purpose the threads must be heated again. To this extent the modification of the invention in which the heating device has at least two separate treatment channels that are traversed simultaneously by a plurality of threads for heat treatment is particularly advantageous. The threads can be heated for texturing within the heating device and after texturing heated for shrinkage treatment in a second pass through the heating device.

In order to keep the free guide zones of the threads within the machine as short as possible, the design of the texturing machine according to the invention is preferably chosen so that the thread inlet of one of the treatment channels and the thread outlet of the other treatment channel are formed on one end of the heating device so that the threads can be guided into the treatment channels in opposite directions.

The treatment channels of the heating device are also configured or heatable so that the threads are differently tempered with equally long guide lengths or with differently long guide lengths. The individual requirements for texturing of the threads and for shrinkage treatment of the threads can therefore be optimally achieved. For this purpose the treatment channels within the heating device could be formed with different lengths.

In order to permit separate guides in the multiplicity of threads within the heating device, the modification of the texturing machine according to the invention in which the heating device has a plurality of heatable heating tubes, at least one of the threads being guidable in each of the heating tubes, is particularly suited. The heating tubes can be arranged bundled in order to be heated jointly via a heating means. Different insulation materials can be allocated to the heating tubes in order to implement temperature differences in the heating tubes.

For continuous texturing of multifilament threads, a separate feed station for pulling a thread from a supply spool is assigned to each processing point. The feed stations can also advantageously be arranged symmetric to the heating device so that the free guide zones of the threads are essentially equally long in adjacent processing points.

In addition, the winding devices assigned to the processing points for winding up the textured thread can also be held in a symmetric arrangement to the heating device so that the free guide zones of the threads in adjacent processing points are essentially equally long.

However, in principle there is also the possibility that the supply stations and the winding devices are divided according to an advantageous modification of the invention into several processing groups, the processing groups of the feed station and winding device being arranged symmetric to the heating device.

In order to be able to replace the supply spools and change the full spools in the winding devices from one service aisle, the modification of the invention in which the processing group of the feed station and the winding device form two machine side walls aligned at right angles to each other, in which the feed station is held in a creel between two subgroups of the winding devices and in which the two subgroups of the winding devices are arranged along the machine side wall, is preferred. Both the winding devices and the feed stations in the creel can therefore be operated from the machine side wall.

The processing groups of the feed stations and winding devices are then preferably held in a square arrangement with a total of four machine side walls, the heating device being arranged in a center area. All doffing work can therefore be executed from the outside on the machine. The process work for positioning the thread, for example, on the other hand, can be carried out in the interior in an intermediate space between the feed stations and the winding devices as well as the heating device.

In order to obtain a simple and rapid operability of all processing points with more than 100 processing points, according to an advantageous modification of the invention the heating device is formed by several separate heating modules and allocated to the individual processing groups of the feed station and winding devices. The feed stations, winding devices, heating modules, delivery mechanisms and texturing units assigned to one of the processing groups are combined to a machine module, in which the machine modules are controllable independently of each other. With a square arrangement of the processing groups, it is therefore possible to advantageously create four processing groups, which can be controlled and operated separately and independently from each other.

The texturing machine according to the invention is characterized by a very compact and energy-saving machine concept, which can be used both for automated texturing machines and for partially automated textile machines.

BRIEF DESCRIPTION OF THE SEVERAL VIEWS OF THE DRAWINGS

The texturing machine according to the invention is further explained below by means of some practical examples with reference to the accompanying figures.

In the figures.

DETAILED DESCRIPTION

Figure 1:
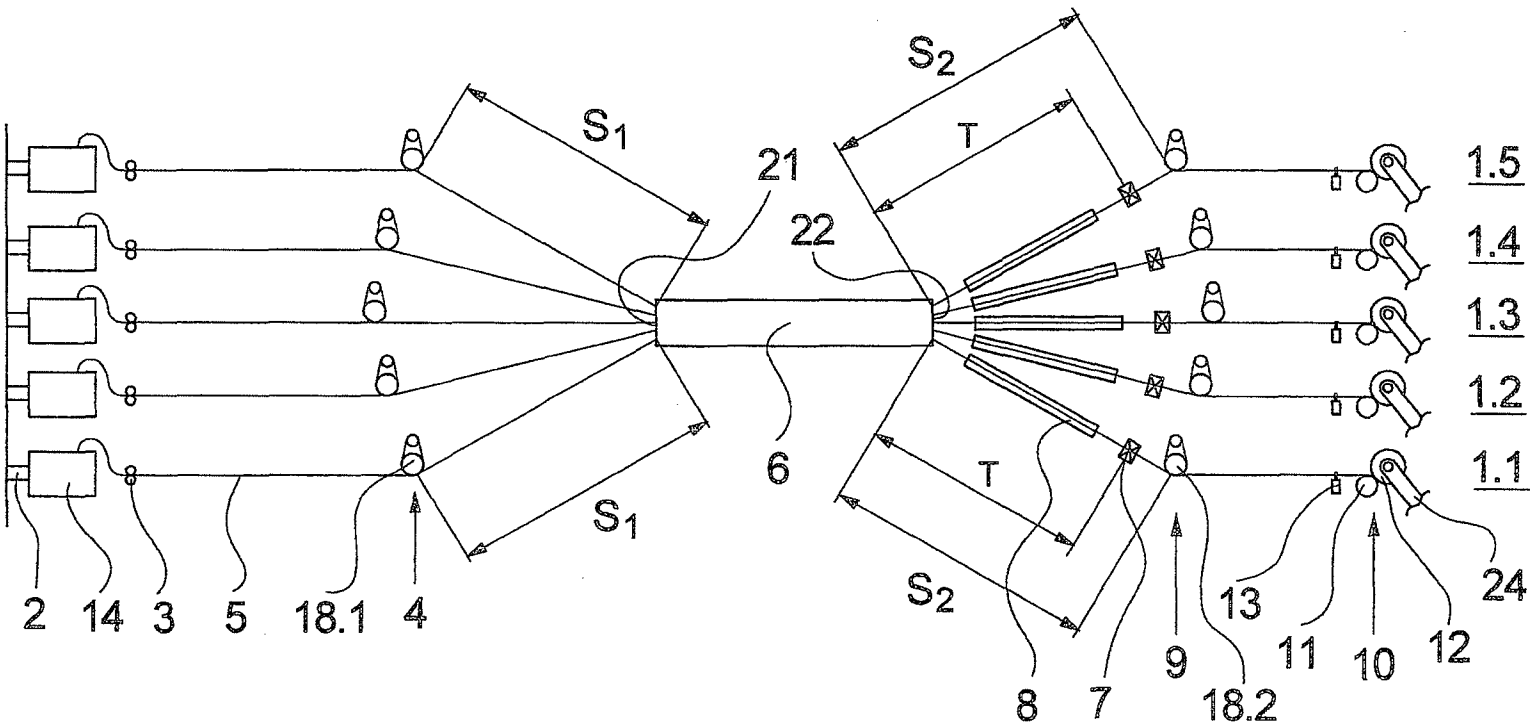
FIG. 1 schematically depicts a view of a first practical example of the texturing machine according to the invention, FIG. 2 schematically depicts a top view of another practical example of the texturing machine according to the invention, FIG. 3 schematically depicts a cross-sectional view of a processing point of the practical example according to FIG. 2, FIG. 4 schematically depicts a top view of another practical example of the texturing machine according to the invention.

A first practical example of the texturing machine according to the invention is schematically depicted in FIG. 1. In the practical example depicted in FIG. 1, only a few processing points are arranged next to each other. Ordinarily such texturing machines have 100, 200 or even more processing points. In the practical example depicted in FIG. 1, a total of five processing points 1.1 to 1.5 are shown. Each of the processing points 1.1 to 1.5 is designed identically in order to guide, draw and texture a thread 5 in each of the processing points 1.1 to 1.5.

The design and arrangement of the process units in the processing points 1.1 to 1.5 will be explained using one of the processing points as an example. Thus, in the first processing point 1.1, a thread 5 is supplied into a feed station 2 by means of a supply spool 14. Feed station 2 can be arranged, for example, with adjacent feed stations in a creel. It is known, for example, that a group of feed stations 2 is formed by a creel with a group of supply spools 14.

A head thread guide 3 is assigned to the feed station 2 so that the head thread guide 3 can pull the thread overhead from the supply spool 14. For this purpose the thread 5 is guided by a first delivery mechanism 4. The first delivery mechanism 4 is formed as an individual delivery mechanism with a multiply wrapped galette 18.1. Within the processing point a central heating device 6 follows the first delivery mechanism 4, through which all threads are simultaneously guided for heating up to the processing points 1.1 to 1.5. For this purpose the heating device 6 has a thread inlet 21 on one end and a thread outlet 22 on the opposite end.

In the subsequent thread path within the processing point 1.1, a cooling device 8 and a texturing unit 7 follow on the outlet side of the heating device 6. A second delivery mechanism 9 is downstream of the texturing unit 7, which is also formed by an individual delivery mechanism in the form of a galette 18.2.

A winding device 10, which winds the textured threads 5 to a spool 12, is arranged on the end of the processing point 1.1. For this purpose the winding device has a spool holder 24 and a drive roll 11, which uniformly drives the spool 12 during winding. The drive roll 11 is upstream of a jig motion device 13 so that the thread 5 is wound in a cross winding.

In order to permit uniform treatment and guiding of the threads within the processing points 1.1 to 1.5, the texturing units 7 assigned to the thread outlet 22 of the heating device 6 are held in a symmetric arrangement to the heating device 6 so that the threads can be guided in equally long texturing zones inside the processing points 1.1 to 1.5. In FIG. 1 the texturing zone between the thread outlet 22 and the texturing unit 7 in the processing point 1.1 is marked by reference character T. The cooling device 8 is arranged within the texturing zone. The texturing zones T in each of the depicted processing points 1.1 to 1.5 are of equal length.

In order to obtain equally long guide zones for drawing of the threads between the first delivery mechanisms 4 of the processing points 1.1 to 1.5 and the second delivery mechanisms 9 of the processing points 1.1 to 1.5, the delivery mechanisms 9 connected upstream of the texturing units 7 in the thread path direction on the outlet side of the heating device are held in a symmetric arrangement to the heating device 6. The guide zone between the thread outlet 22 of the heating device 6 and the second delivery mechanism 9 is marked by the reference character $S_2$. Likewise, the delivery mechanisms 4 of the processing points 1.1 to 1.5 are held in a symmetric arrangement to the thread inlet 21 of the heating device 6, said delivery systems being upstream of heating device 6 in the thread path direction. Here the guide zone $S_1$ between the first delivery mechanism 4 and the thread inlet 21 of the heating device is shown. Consequently, in addition to the texturing zones T, all guide zones $S_1$ and $S_2$ are made equally long between the first delivery mechanisms 4, the heating device 6 and the second delivery mechanisms 9 in the processing points 1.1 to 1.5. In the practical example depicted in FIG. 1, the feed stations 2 and the winding devices 10 are arranged next to each other in a parallel arrangement so that a machine side wall parallel to the feed stations 2 and a second machine side wall parallel to the winding devices 10 are formed. Spool transport of both the supply spools and also the finely wound spools therefore preferably occurs through the service aisles assigned to the machine side walls. In principle, however, there is also the possibility of arranging the feed stations 2 and the winding devices 10 symmetrically to the central heating device 6 with equal spacing.

Figure 2:
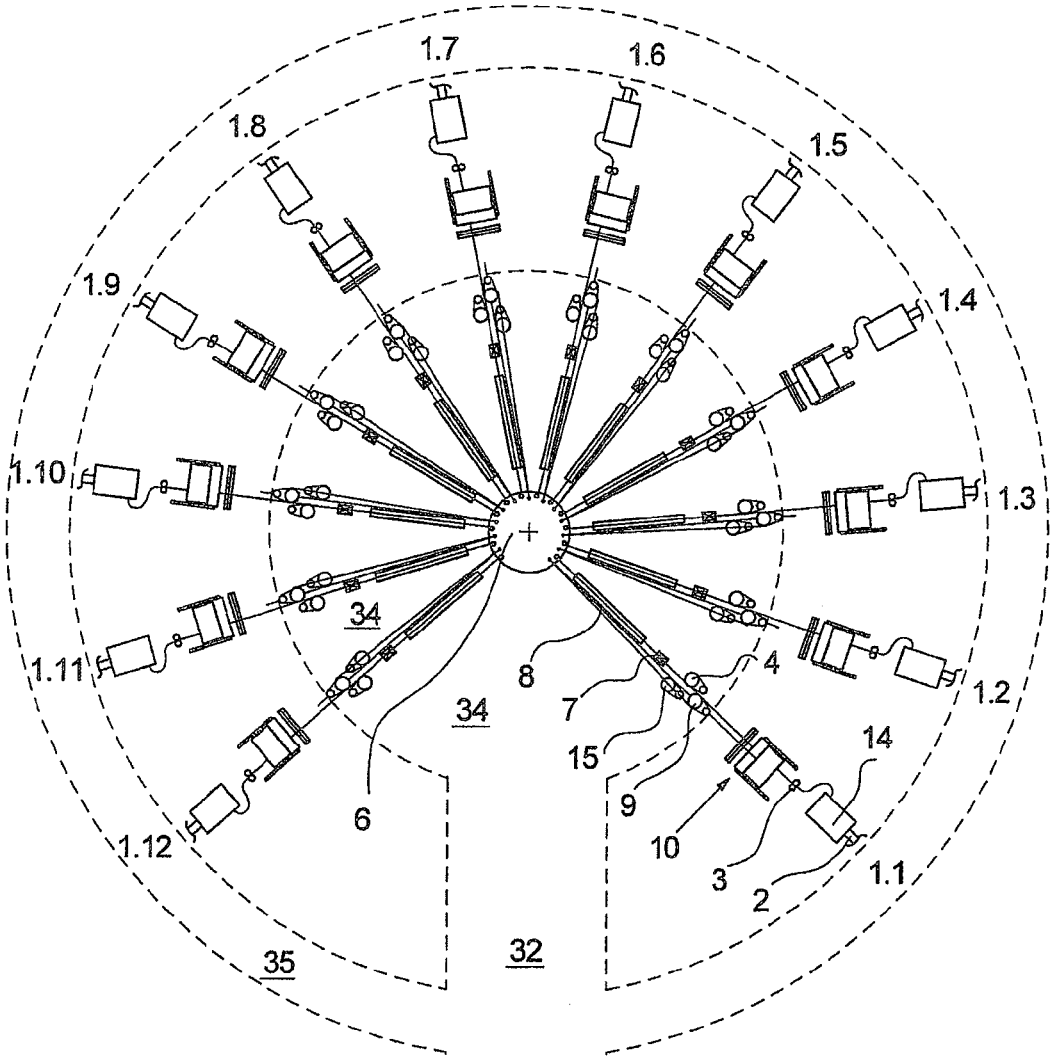
Figure 3:
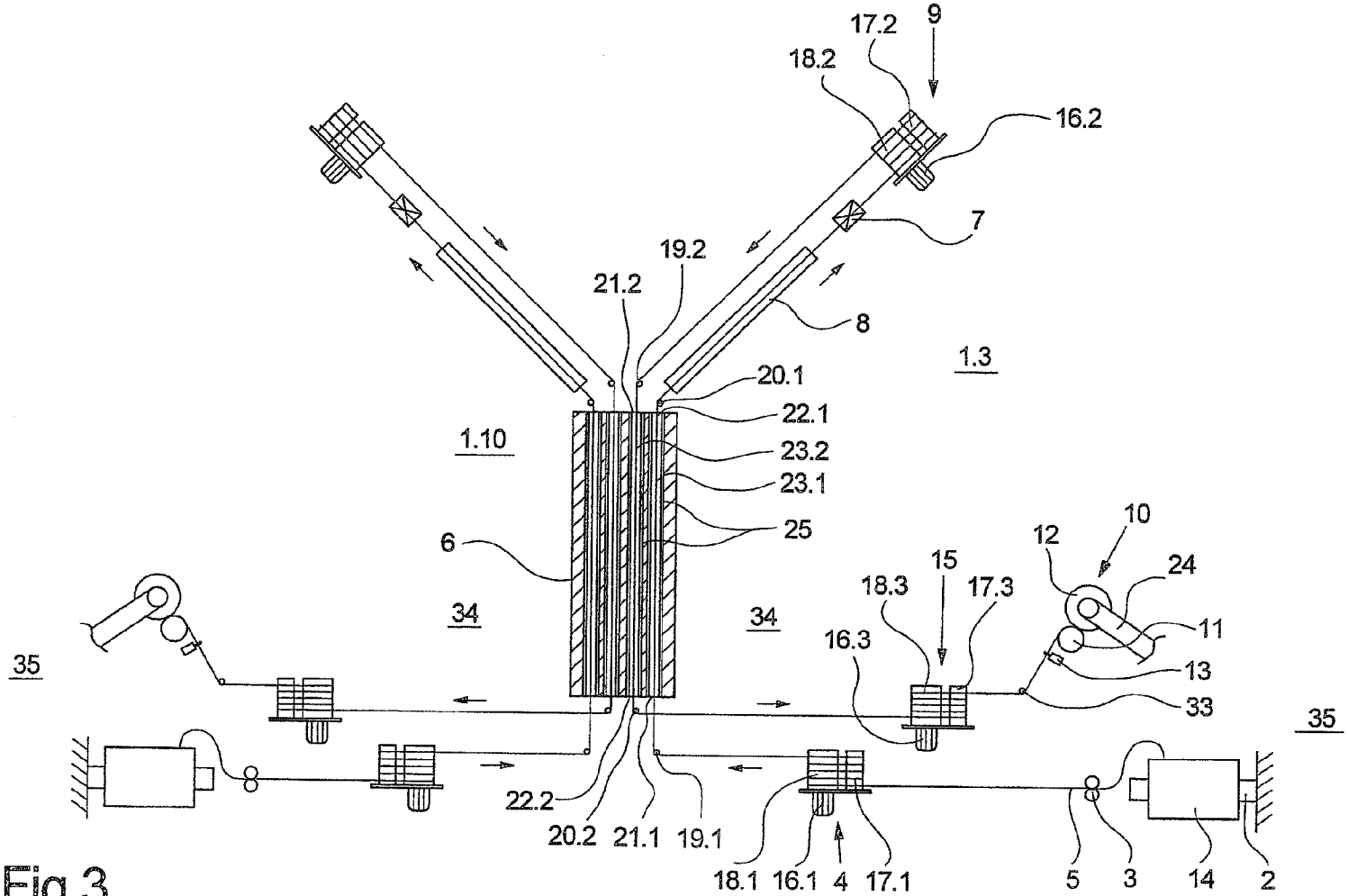

Another practical example of the texturing machine according to the invention is shown in FIGS. 2 and 3 in which the feed stations and the winding devices are arranged symmetrically to the heating device with equal spacings. A top view of the practical example is shown in the FIG. 2 and a cross-sectional view is shown in FIG. 3. To the extent that no explicit reference to one of the figures is made, the following description applies to both figures.

A total of 12 processing points 1.1 to 1.12 are assigned to the central heating device 6 in the depicted practical example.

As follows from the depiction of FIG. 2, the heating device 6 is arranged in a middle area of the machine. The process units of the processing points 1.1 to 1.12 are each held next to each other in a partially circular arrangement with a spacing to the heating device 6. The heating device 6 forms the center of the machine arrangement. All other process units are arranged in a stellate distribution around the heating device 6. The process units of the same type, like the texturing units 7, each have the same spacing to the heating device in the processing points 1.1 to 1.12 so that equally long texturing zones are produced within the processing points 1.1 to 1.12.

The processing points 1.1 to 1.12 in their design and arrangement are designed identically to the process units. To this extent the essential design of the processing points 1.1 to 1.12 is described below using of one of the processing points as example.

A cross-sectional view of two processing points 1.3 and 1.10 opposite each other in mirror image fashion is shown in FIG. 3. The processing point 1.3 has a feed station 2, arranged with the greatest space to the heating device in the outer area of the machine. The feed station 2 contains a feed supply 14 from which a thread 5 is pulled via a first delivery mechanism 4. For thread guiding, a head thread guide 3 is arranged between the first delivery mechanism 4 and the feed station 2. The first delivery mechanism 4 is formed by a galette 18.1 and an overflow roll 17.1. The galette 18.1 is driven via galette motor 16.1. In order to be able to execute the required tensile forces for pulling the thread 5 from the supply spool 14, the galette 18.1 and the overflow roll 17.1 are multiply wrapped by the thread 5.

In the subsequent thread path, the thread 5 is guided to a thread inlet 21.1 of the heating device 6. The heating device 6 is vertically aligned for this purpose and has the thread inlet 21.1 on the bottom. On the opposite top, a thread outlet 22.1 is formed. The thread inlet 21.1 and the thread outlet 22.1 are formed on the ends of a treatment channel 23.1. The treatment channel 23.1 is designed heatable within the heating device 6. In this practical example the treatment channel 23.1 is formed by a heating tube 25, which can be heated, for example, by steam or an electrical heating means. A thread inlet 21.1 and a thread outlet 22.2 are respectively assigned an inlet thread guide 19.1 and an outlet thread guide 20.1 through which the incoming or outgoing thread 5 is deflected.

Above the heating device 6, the processing point 1.3 has a cooling device 8, a texturing unit 7 and a second delivery mechanism 9. The cooling device 8, the texturing unit 7 and the second delivery mechanism 9 are arranged one behind the other relative to a straight thread path, in which the texturing unit 7 delimits the texturing zone.

The second delivery mechanism 9 is formed by a galette 18.2 and an overflow roll 17.2 in which the galette 18.2 is driven by the galette motor 16.2. The galette 18.2 of the second delivery mechanism 9 is driven with higher circumferential speed relative to the galette 18.1 of the first delivery mechanism 4 so that the thread 5 is drawn within the texturing zone. In each of the processing points 1.1 to 1.12 the guide zone of the thread 5 is equally long between the first delivery mechanism 4 and the second delivery mechanism 9.

Within the processing point 1.3 the thread 5 is deflected by 180° on the second delivery mechanism 9 and fed back to the heating device 6. The second separate treatment channel 23.2, through which final treatment of the textured thread 5 can be performed, is formed within the heating device 6. The second treatment channel 23.2 has a thread inlet 21.2 on the top of the heating device 6 and a thread outlet 22.2 on the bottom. The treatment channels 23.1 and 23.2 are therefore traversed in opposite directions by the thread 5. The treatment channel 23.2 in this practical example is also formed by a heating tube 25, which can be heated by a heating device not further shown here. There is the possibility here of performing different tempering of the treatment channels 23.1 and 23.2 by differing insulation or by separate heating devices so that the thread is heated differently in equally long guide zones within the heating device 6.

A third delivery mechanism 15 to guide the thread 5 is provided beneath the heating device 6, which is also formed by a driven galette 18.3 (driven by galette motor 16.3) and a freely rotatable overflow roll 17.3. A speed difference required for shrinkage treatment is set between the galette 18.2 of the second delivery mechanism 9 and the galette 18.3 of the third delivery mechanism 15. Two thread guides 19.2 and 20.2 are also assigned to the thread inlet 21.2 and the thread outlet 22.2 for thread guiding. The inlet thread guide 19.2 and the outlet thread guide 20.2 can be formed by guide pulley or guide pins.

A winding device 10 is arranged downstream of the third delivery mechanism 15 in the processing point 1.3. The winding device 10 has a spool holder 24 on which a spool 12 to be wound is rotatably mounted. The spool 12 lies with its periphery against the drive roll 11, which drives the spool 12 with constant circumferential speed. The drive roll 11 is arranged ahead of a jig motion device 13 in the thread path so that the textured thread 5 is wound to a cross-wound bobbin. A guide rod 33, through which the thread 5 is guided to the winding device 10, is arranged between the third delivery mechanism 15 and the winding device 10 to guide the thread.

The design of the process units depicted in this practical example is an example and only contains the essential process units for guiding, drawing and texturing of the thread. In principle, it is common to wet the thread 5 with a lubricant in front of the winding device 10. For example, a lubricant is provided between the third delivery mechanism 15 and the winding device 10. It is also known to intermingle the thread before shrinkage treatment and after texturing. Thus, an intermingling device and an additional delivery mechanism can be arranged in the guide zone between the second delivery mechanism 9 and the thread inlet 21.2 of the heating device 6.

It is also known that the winding devices 10 have a width that is essentially greater than the width of the delivery mechanisms 4, 9 and 15 arranged upstream of the processing point. Ordinarily a total of three texturing zones of adjacent processing points lying one next to the other can be arranged within a width of the winding device so that adjacent winding devices are held stage-like one above the other.

In the practical example depicted in FIGS. 2 and 3 operation for a spool change occurs from an inner service aisle 34. The service aisle 34 is formed in the intermediate space between the heating device 6 and the winding devices 10 of the processing points 1.1 to 1.12. On the outside of the machine opposite the winding devices 10, there is also formed a service aisle 35, which is used for transport of supply spools 14 to the feed stations 2. Placement of thread in the processing points 1.1 to 1.12 at the beginning of the process occurs from the inner service aisle 34.

As follows from the depiction in FIG. 2, an access 32, through which the inner service aisle 34 is connected to the outer service aisle 35, is formed between the processing points 1.1 and 1.12.

The practical example of the texturing machine according to the invention according to FIG. 2 and FIG. 3 is characterized in that within the processing points 1.1 and 1.12, all guide zones and texturing zones are made equally long. To this extent each of the threads within the processing points 1.1 to 1.12 is doffed, guided, drawn, textured and wound under the same conditions.

Figure 4:
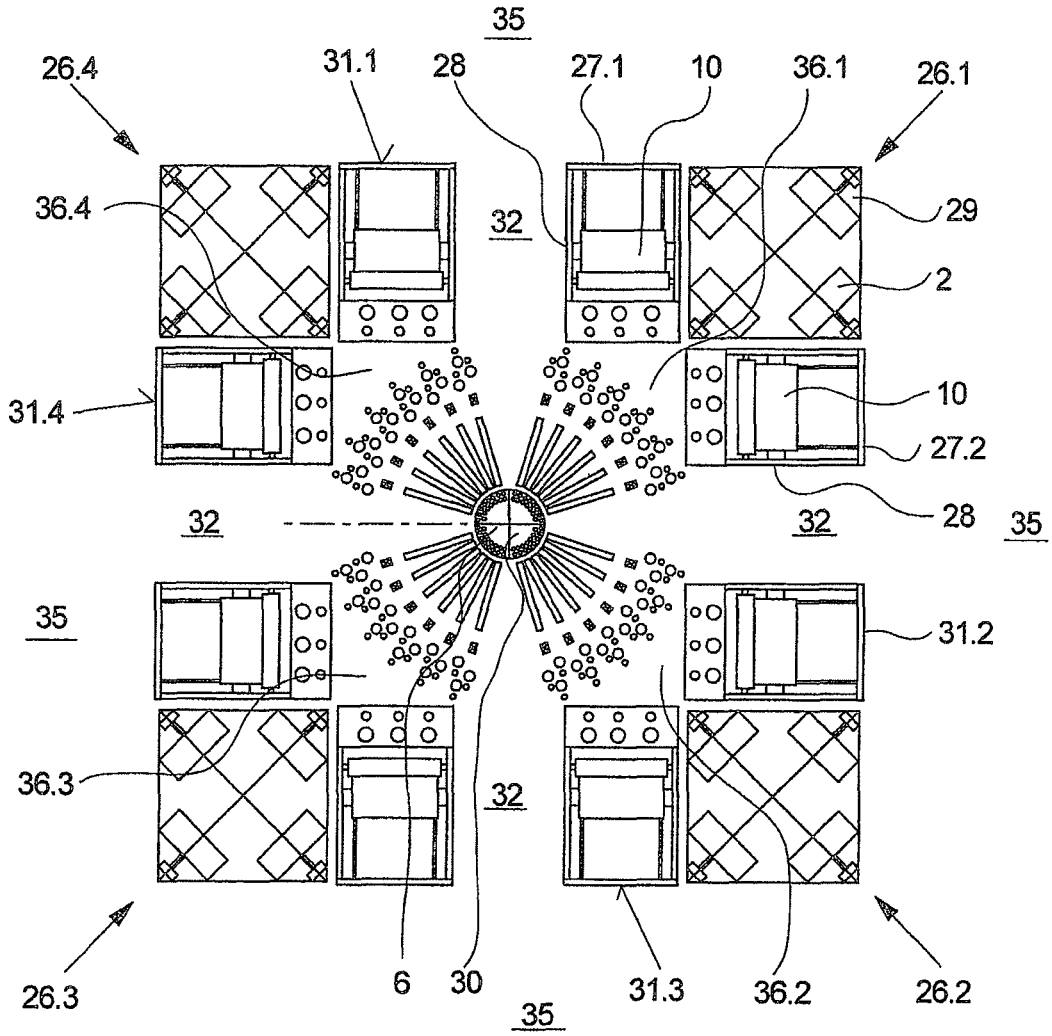

However, in practical operation texturing machines are also often used in which more than 200 processing points are integrated. The practical example of the texturing machine according to the invention depicted in FIG. 4 is especially suited for such large machines. A top view of the practical example is shown in FIG. 4.

The practical example has a heating device 6 arranged in a center area. The heating device 6 is assigned a total of 96 processing points arranged symmetrically to the heating device 6. Each of the processing points is designed identical and has a basic design as already described relative to FIG. 3. To this extent, reference is made to the previous description.

In the practical example depicted in FIG. 4, the feed stations and the winding devices are divided into several processing groups 26.1, 26.2, 26.3 and 26.4. Each of the processing groups 26.1 to 26.4, the feed stations 2 and the winding devices 10 form two machine side walls aligned at right angles to each other. The processing group 26.1 forms the machine side walls 31.1 and 31.2 outward. The feed stations 2 are arranged at a creel 29, the creel 29 being arranged between subgroups 27.1 and 27.2 of the winding device 10. The winding devices 10 are held stage-like by a winding module 28, which extends along the machine side walls 31.1 and 31.2 in subgroups 27.1 and 27.2. The subgroup 27.1 of the winding device 10 here forms the machine side wall 31.1 and the subgroup 27.2 of the winding device 10 forms the machine side wall 31.2.

The processing groups 26.1 and 26.4 are arranged in a square arrangement around the heating device 6 so that a total of four machine side walls 31.1 to 31.4 are produced. The creels 29 of the processing groups 26.1 to 26.4 are arranged in the corners.

To operate a multiplicity of processing points, the heating device is formed by several separate heating modules, a heating module 30 being assigned to each of the processing groups 26.1 to 26.4. Thus, the processing points assigned to the processing groups 26.1 to 26.4 are combined to a machine module 36.1 to 36.4 in terms of control. The machine modules 36.1 to 36.4 can be controlled independently of each other so that the processing points assigned to the processing groups 26.1 to 26.4 can be operated and controlled group by group within the complete machine.

Positioning of the thread within the processing points at the beginning of the process occurs from an inner service aisle 34 formed between the winding modules 28 and the heating device 6. The spool change and equipping of the creels 29 with new supply spools occurs through an outer service aisle 35 that extends along the machine side walls 31.1 to 31.4. The inner service aisle 34 is connected to the outer service aisle 35 via several accesses 32. The accesses 32 are formed here between adjacent processing groups 26.2 and 26.3.

In the practical examples of the texturing machine according to the invention depicted in FIGS. 1 to 4, the layout and design of the process units are shown as examples but the texturing units are preferably formed by so-called friction false twist devices in which several friction disks are drive on a total of three friction spindles and in which the thread is guided in an overlapping area of the friction disks to generate the false twist. Both cooling rails and cooling tubes can be used as cooling devices, against which the thread is brought in contact. It is essential for the invention that the center of the machine is formed by a heating device. High energy saving for heat treatment of the threads can therefore be achieved. In addition, very compact heating devices can be implemented with limited insulation.

The invention claimed is:

1. A texturing machine, said texturing machine comprising:

a plurality of processing points for texturing of a number of multifilament threads with a plurality of delivery mechanisms and one texturing unit per processing point for guiding, drawing and texturing of one of the threads within the processing point and with a central heating device which is assigned to the processing points for heat treatment of a plurality of threads, in which the texturing units of the processing points arranged on an outlet side of the heating device each delimit a texturing zone within the processing point, wherein the texturing units of the processing points, which texturing units are assigned to a thread outlet of the heating device, are held in a symmetric arrangement to the heating device so that the threads can be guided in equally long texturing zones within the processing points.

2. The texturing machine according to claim 1, wherein the delivery mechanisms arranged downstream of texturing unit of the processing points in a thread path direction are held as individual delivery mechanisms in a symmetric arrangement to the heating device.

3. The texturing machine according to claim 1, wherein the heating device is aligned vertically and wherein the texturing units are held next to each other in a semicircular arrangement with a spacing relative to the thread outlet of the heating device.

4. The texturing machine according to claim 1, wherein the delivery mechanisms of the processing points arranged downstream of the heating device in a thread path direction are held as individual delivery mechanisms in a symmetrical arrangement to a thread inlet of the heating device.

5. The texturing machine according to claim 3, wherein a thread inlet is formed on the bottom of the heating device and the thread outlet on the top thereof and wherein the texturing units are arranged in one plane above the heating device.

6. The texturing machine according to claim 1, wherein the heating device has at least two separate treatment channels that are traversed simultaneously by one or more threads for heat treatment.

7. The texturing machine according to claim 6, wherein a thread inlet of one of the treatment channels and a thread outlet of the other treatment channel are formed on an end of the heating device so that the threads can be guided into the treatment channels in opposite directions.

8. The texturing machine according to claim 6, wherein the treatment channels of the heating device are configured or heatable so that the threads are differently temperable.

9. The texturing machine according to claim 1, wherein the heating device has a number of heatable heating tubes, and wherein at least one of the threads can be guided into each of the heating tubes.

10. The texturing machine according to claim 1, wherein each of the processing points has a separate feed station for removing one of the threads from a supply spool and wherein the feed stations are arranged symmetrically to the heating device so that the guide zones of the threads in adjacent processing points are essentially of equal length.

11. The texturing machine according to claim 1, wherein each of the processing points has a separate winding device for winding the textured thread to a spool and wherein the winding devices are arranged symmetrically to the heating device so that the guide zones of the threads in adjacent processing points are essentially of equal length.

12. The texturing machine according to claim 1, wherein each of the processing points has a separate feed station for removing one of the threads from the supply spool and a separate winding device for winding the textured thread to a spool, wherein the feed stations and the winding devices are divided into several processing groups and wherein the processing groups of the feed stations and the winding devices are arranged symmetrically to the heating device.

13. The texturing machine according to claim 12, wherein the processing groups of the feed stations and the winding devices form machine side walls aligned at right angles to each other, in which the feed stations are held in a creel between two subgroups of the winding devices and in which the two subgroups of the winding devices are arranged along the machine side walls.

14. The texturing machine according to claim 12, wherein the processing groups of the feed stations and the winding devices are held in a square arrangement with a total of four machine side walls, the heating device being arranged in a center area.

15. The texturing machine according to claim 12, wherein the heating device is formed by several separate heating modules, each of the processing groups of the feed stations and winding devices being assigned one of the heating modules.

16. The texturing machine according to claim 15, wherein the feed stations, winding devices, heating modules, delivery mechanisms and texturing units assigned to one of the processing groups form a machine module and wherein the machine modules can be controlled independently of each other.

* * * * *